United States Patent [19]

Dobner

[11] Patent Number: 4,854,275

[45] Date of Patent: Aug. 8, 1989

[54] CYLINDER HEAD FOR A COMBUSTION ENGINE

[75] Inventor: Alfred Dobner, Rosstal, Fed. Rep. of Germany

[73] Assignee: Alcan International Ltd., Montreal, Quebec, Canada

[21] Appl. No.: 209,051

[22] Filed: Jun. 20, 1988

[30] Foreign Application Priority Data

Jun. 25, 1987 [DE] Fed. Rep. of Germany ..... 3721029

[51] Int. Cl.[4] ..... F02F 1/36

[52] U.S. Cl. ..... 123/193 H; 123/41.82 R

[58] Field of Search ..... 123/193 H, 41.82, 669, 123/668

[56] References Cited

U.S. PATENT DOCUMENTS 4,337,735 7/1982 Lichtner ..... 123/193 H 4,426,963 1/1984 Lichtner ..... 123/193 H

*Primary Examiner*—E. Rollins Cross

*Attorney, Agent, or Firm*—Cooper & Dunham

[57] ABSTRACT

Cylinder head for a combustion engine which has at least one web insert embedded in the cylinder head in the bridge region between the inlet and outlet valves. In order to prevent the occurrence of heat cracks at the root of the expansion joint receiving the web insert upon cooling of the cylinder head after its casting, the web insert has at least one opening, window or lateral cutout. Through this opening, window or cutout, the material of the cylinder head located on both sides of the web insert is directly connected together.

8 Claims, 2 Drawing Sheets

CYLINDER HEAD FOR A COMBUSTION ENGINE

The invention relates to a cylinder head for a combustion engine which has at least one web insert in the bridge region of its wall delimiting the combustion chamber between the inlet and outlet valves, which web insert consists of a cast-in component and is embedded in said wall in such manner that its major dimension extends substantially perpendicularly to the surface thereof.

Such cylinder heads are already known. The web inserts of sheet form which are provided form expansion joints in the material of the cylinder head when cast therein, which expansion joints are to be protected by the inserts against coking and are thus to be maintained functional for a long period.

In cylinder heads, in particular in air cooled cylinder heads of light metal, above all the bridge, which is located between the valve openings in the base of the cylinder head, is exposed to high operating temperatures, whilst the zones of the cylinder head lying further away remain substantially cooler. As a result of this, and as a result of the alternating thermal loading of the cylinder head between operating an rest conditions, in the zones exposed to the high operating temperatures, such as in the web mentioned above, there occur alternating tension and compression forces which load the material of the cylinder head beyond the yield point and can lead to crack formation, possibly even to fracture in the region of the web, as a result of which the cylinder head becomes unusable.

Attempts have been made to prevent this in the above mentioned known state of the art by the provision of expansion joints in the form of web plates. It is true that by this means it has been possible to shift the tension and compression forces into the depth of the bridge, and thus into the cooler zones of the cylinder head to the extent of the depth of the expansion joints. It is true that as a result the danger of loading the material above the yield point at the root of the expansion joint is reduced, but however the danger of crack formation, particularly the initiation and propagation of cracks in the material of the cylinder head, was not completely prevented. Moreover, during casting of the cylinder head, owing to the plates extending into the bridge of the cylinder head the flow of material was susceptible to disruption and also the crystallisation process was disadvantageously altered by the differing heat conductivity of web insert and the material of the bridge. As a result, in the solidification and cooling of the cast cylinder head, once more heat cracks appeared at the root of the expansion joint which enlarged as a result of temperature fluctuations during engine operation.

The invention is therefore based on the object of preventing the appearance in a cylinder head of the above-mentioned type of heat cracks at the root of the expansion joint receiving the web inserts upon cooling of the cylinder head after its casting, that is to say by corresponding reduction of the shrinking forces exerted on the root of the expansion joint. Since as a result of the later heat treatment, the material stresses occurring upon cooling after casting are removed, the invention is particularly based on the object of preventing crack formation caused by shrinkage stresses at least until they are reduced by heat treatment.

This object is achieved according to the invention in that the web insert has at least one opening, a window or a lateral cutout. By this means, a complete separation of the construction material of the cylinder head located on both sides of the web insert is prevented; on the contrary, by means of the opening, the window or the cutout the material is continuous throughout. As a result, the occurrence of heat cracks at the root of the expansion joint during solidification and cooling of the cast cylinder head is prevented and the formation of a shrinkage gap , otherwise visible after cooling of the cylinder head, between the web insert and the cylinder head material is largely prevented. Thus, the expansion joint and its intended function, that is to say the diversion of the tension and compression stresses caused by temperature fluctuation into the cooler regions of the material of the cylinder head, is fulfilled without the occurrence of cracks at the root of the expansion joint. Furthermore, by means of the opening, window or cutout provided according to the invention during casting of the cylinder head, better material flow is achieved which reduces the formation of vortex induced oxide skins. Moreover, better heat flow results and thus better crystallisation as a result of which structural weaknesses and shrinkage cavities are prevented.

The web insert can have one or more such openings, or windows or lateral cutouts, these having various possible shapes, such as for example circular, slotshap, rectangular, square or the like. The surface or the sum of the surfaces of the opening or openings or window or cutout should be so dimensioned that they can absorb at least the desired portion of the shrinkage stresses acting on the root of the expansion joint, but they must not be larger than the smallest cross-sectional surface of the bridge; with reference (strictly) to the depth of the web insert, in order to act as a rated break point under operational forces and not to nullify the effect of the expansion joint. In this connection, it can be advantageous if the spacing of the centre point of the opening or openings, windows or cutouts from the bridge surface amounts to at least a quarter of the overall depth of the web inserts.

Preferably, the overall surface of the opening or openings, window or cutout has at least the value F, as defined by the following equation:

$$F = \frac{S \cdot E \cdot b \cdot t_1^3 \cdot (100 - y)}{t^2 \cdot 2 \cdot l_o \cdot \sigma\, zul}$$

where:

F = Surface of the opening or overall surface of all openings in $mm^2$

S = Observed gap width in cylinder-heads without penetrated web plate in mm

E = Modulus of elasticity of the bridge material in $N/mm^2$ b = Width of the web plate in mm at the point of the opening (average width) in mm $t_1$ = Depth of the opening, measured from the end point of the web plate t = Depth of the overall web plate on the unprocessed head in mm y = % of the desired stress reduction $l_0$ = Mutual spacing of the web plates in mm $\sigma$ zul = Permissible stress of the bridge material at low temperature in $N/mm^2$.

Particularly advantageous exemplary embodiments of the web insert according to the invention as well as its arrangement in the cylinder head will be described in more detail in the following with reference to the drawing, in which.

Figure 1:
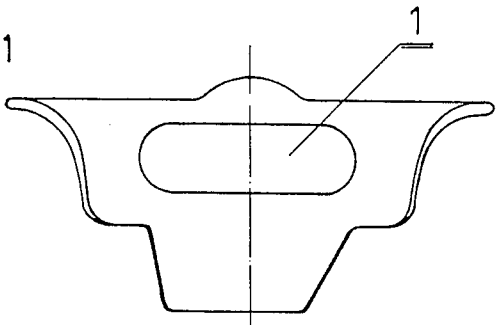
FIGS. 1 to 3 show three exemplary embodiments in separate plan views.
Figure 2:
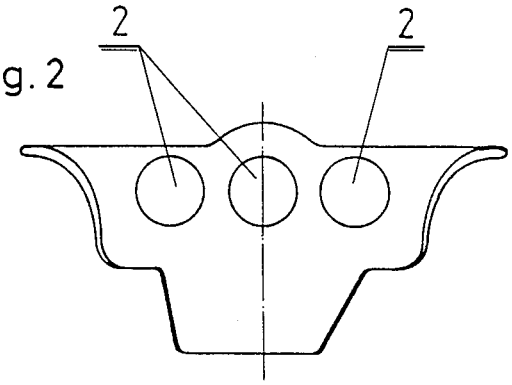
Figure 3:
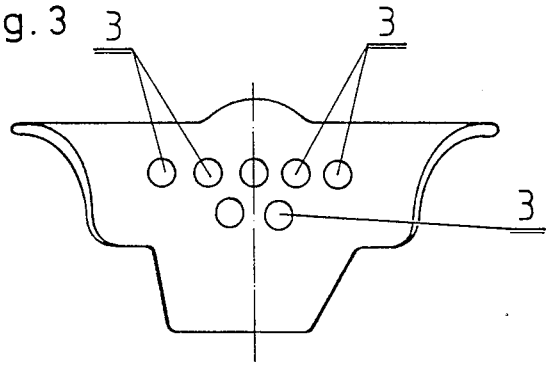
Figure 4:
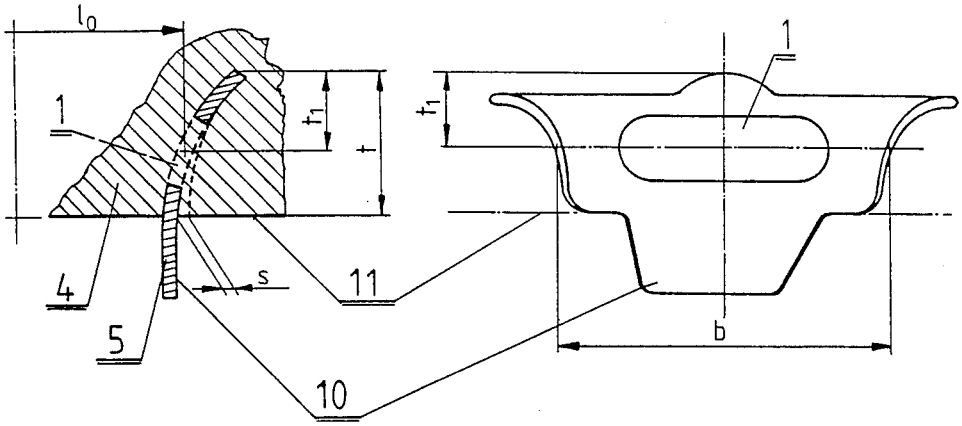
FIG. 4 shows the exemplary embodiment according to FIG. 1 in its cast-in condition with the parameters contained in the above-mentioned formula.
Figure 5:
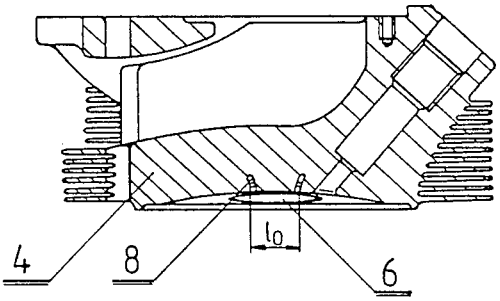
Figure 6:
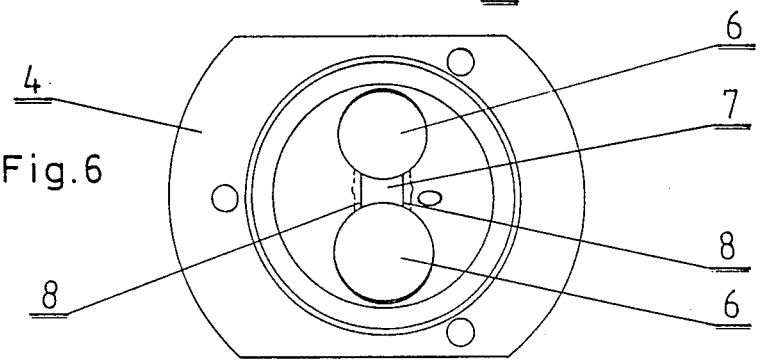

FIG. 5 shows the arrangement of two web inserts according to the invention in a cylinder head in sectional view; and FIG. 6 shows this arrangement in plan view of the base of the cylinder head The exemplary embodiments of a web insert according to the invention illustrated in FIGS. 1 to 3 have equal dimensions and are upwardly domed into the upper region in the Figures which is to be cast into the cylinder head In this domed region, the insert in the exemplary embodiment according to FIG. 1 has a single window-like opening 1 in the form of an elongate slot, whilst the exemplary embodiment according to FIG. 2 has instead of this three window-like openings 2 in circular form. In the exemplary embodiment according to FIG. 3, two rows of small openings 3 are provided which are circular in cross section. All these openings ensure, after casting of the web insert into the cylinder head, interconnection of the material of the cylinder head located on both sides of the web insert, whereby the above-described advantages are achieved FIG. 4 illustrates that the web inserts are cast only with their domed part containing the opening 1 into the cylinder head 4 in order that they extend with their major dimensions substantially perpendicularly to the surface thereof The other part of the web insert forms an anchoring member 10 which during casting serves for fixing the web insert in the casting. It is then separated from the finished cast article with its length extending beyond the cast surface 11 by mechanical processing. FIG. 4 furthermore shows the width of the gap s, which would result with cylinder heads 4 having a web insert 5 cast therein if it were not provided with the opening window or cutout according to the invention.

FIGS. 5 and 6 show a cylinder head which has two web inserts which are arranged on both sides of the web 7 located between the valve opening 6 in the base of the cylinder head.

I claim:

1. Cylinder head for a combustion engine which has at least one web insert in the bridge region of its wall delimiting the combustion chamber located between the inlet and outlet valves, which web insert consists of a cast-in component and is embedded in said wall in such manner that it extends with its major dimension substantially perpendicularly to the surface thereof, wherein the web insert has at least one opening, window or lateral cutout.

2. Cylinder head according to claim 1, wherein the overall surface of said at least one opening, window or cutout is no larger than the surface of the smallest bridge cross section with reference to the depth of the web insert.

3. Cylinder head according to claim 1, wherein the overall surface of said at least one opening, window or cutout of the web insert is no smaller than 10% of the surface of the smallest bridge cross section, with reference to the depth of the web insert

4. Cylinder head according to claim 2, wherein the overall surface of said at least one opening, window or cutout of the web insert is no larger than half the surface of the smallest bridge cross section with reference to the depth of the web insert.

5. Cylinder head according to claim 1, wherein the average distance of said at least one opening, window or cutout from the bridge surface is at least a quarter of the overall depth of the web insert.

6. Cylinder head according to claim 5, wherein the average spacing of said at least one opening, window or cutout from the bridge surface is at least a third of the overall depth of the web insert.

7. Cylinder head according to claim 5, wherein the spacing of said at least one opening, window or cutout from the cylinder surface is smaller than the height of the opening or the like measured in the direction of this spacing.

8. Cylinder head according to claim 1 comprising two mutually spaced oppositely lying web plates, wherein the overall surface of the openings, windows or cutouts of the web insert has at least the value F, which is defined by the following equation:

$$F = \frac{S \cdot E \cdot b \cdot t_1^3 \cdot (100 - y)}{t^2 \cdot 2 \cdot l_o \cdot \sigma\, zul}$$

where,

F = Surface of the opening or overall surface of all openings in $mm^2$

S = Observed gap width in heads without penetrated web plate in mm

E = Modulus of elasticity of the web material in $N/mm^2$ b = Width of the web plate in mm at the point of the opening (average width) in mm $t_1$ = Depth of the opening, measured from the end point of the web plate t = Depth of he overall web plate on the unprocessed head in mm y = % of the desired stress reduction $l_0$ = Mutual spacing of the web plates in mm $\sigma$ zul = Permissible stress of the web material at low temperature in $N/mm^2$.

* * * * *